US005632627A

United States Patent [19]

Aoki

[11] Patent Number: 5,632,627

[45] Date of Patent: May 27, 1997

[54] CONNECTION ELECTRODE CONNECTING DEVICE

[75] Inventor: Nobuo Aoki, Nagoya, Japan

[73] Assignee: Brother Kogyo Kabushiki Kaisha, Nagoya, Japan

[21] Appl. No.: 526,230

[22] Filed: Sep. 11, 1995

[30] Foreign Application Priority Data

Feb. 15, 1995 [JP] Japan ..... 7-026805
Jul. 24, 1995 [JP] Japan ..... 7-186890

[51] Int. Cl.[6] ..... H01R 9/09

[52] U.S. Cl. ..... 439/67

[58] Field of Search ..... 439/67, 77, 493, 439/66

[56] References Cited

U.S. PATENT DOCUMENTS 4,878,070 10/1989 Watrobski ..... 439/67
5,372,512 12/1994 Wilson et al. ..... 439/67

*Primary Examiner*—Gary F. Paumen
*Assistant Examiner*—Christopher Goins
*Attorney, Agent, or Firm*—Oliff & Berridge

[57] ABSTRACT

Connection electrodes provided on the surface of a base film of a flexible substrate are pressed into contact with opposing electrodes provided on the surface of a facing rigid substrate. Backup members press the base film from the rear of each connection electrode. Each of the backup members has a cylindrical base portion and a conical tip portion which contacts a concave surface of the base film at the rear of each connection electrode. The conical tip portions are formed of an inelastic resin which does not deform elastically even if subjected to pressure and the cylindrical base portions are formed of an elastic resin which has a springiness. The cylindrical base portions apply a spring force to the base film when compressed so that the connection electrodes and the opposing electrodes form good electrical connections.

15 Claims, 8 Drawing Sheets

CONNECTION ELECTRODE CONNECTING DEVICE

BACKGROUND OF THE INVENTION

1. Field of the Invention

The invention relates to a connection electrode connecting device having a plurality of opposing electrodes provided on a substrate surface, the connection electrodes being provided on approximately hemispherically shaped protrusions on a flexible substrate provided so as to face each of the opposing electrodes, and a support member which provides a pressing force from the rear of the protrusions.

2. Description of Related Art

This type of connection electrode connecting device is used in connections between flexible circuits and the heads of ink ejecting printers, such as is disclosed in U.S. Pat. No. 5,262,802.

With such an ink ejecting printer, a plurality of nozzles are provided on the head, and a heating resistor is provided in the back of each nozzle. If a predetermined current is supplied to the heating resistor when ink is supplied near each heating resistor, the ink near the heating resistors to which current has been supplied is heated to a boiling state, and is sprayed from the nozzles corresponding to the printing information.

Because the head is always moving, the supplying of electricity to each of the heating resistors is conducted by means of a flexible circuit which is composed of a semiconductor pattern formed on a pliable resin substrate. In addition, because it is necessary to change the heads each time all of the ink in the head has been consumed, the head is removably attached to a carriage. Furthermore, the supply of electricity to each of the heating resistors is conducted by causing contact between the opposing electrodes provided on the head surface and a connection electrode provided on the flexible circuit surface.

In addition, the connection electrode connecting device of this type of printer is disclosed in U.S. Pat. No. 4,706,097. With this type of connection electrode connecting device (FIG. 9), the resin substrate 14 of the flexible circuit 15 is raised from the substrate surface by the connection electrode 13 installation portion. The connection electrode 13 easily contacts the opposing electrodes 12 provided on the rigid substrate 11. On the other hand, a support plate (not shown) opposes the head (not shown) so that the flexible circuit 15 that is interposed therebetween is provided on the carriage (not shown). Rubber backup members 18 are formed on the support plate surface so that a backup member 18 contacts the resin substrate 14 from behind each of the connection electrodes 13. Through these backup members 18, the connection electrodes 13 and each of the opposing electrodes 12 are kept in a state of being pressed into contact with one another.

Each backup member 18 is composed of a conical portion 16 that contacts the resin substrate 14 and a cylindrical base portion 17. Because the conical portion 16 and the cylindrical base portion 17 are formed integrally of the same material (rubber), the spring constant of the conical portion 16, which has the shape of a cone, is smaller than the spring constant of the cylindrical base portion 17, which has the shape of a cylinder.

In a flexible circuit 15, such as described above, there are cases wherein a variance is created in the height to which the electrodes are raised from the surface of the resin substrate

14, such as is shown in FIG. 13, through the press process whereby the connection electrode 13 portion of the resin substrate 14 is caused to be raised. In such a case, when the connection electrodes 13 are caused to make contact with the opposing electrodes 12, the connection electrode 13B, which has a lower height than the surrounding connection electrodes 13, makes first contact with its backup member 18B and begins its compression process first.

Next, as shown in FIG. 14, the pressure necessary to deform the resin substrate 14 by the difference h in height of the adjacent connection electrodes 13 is applied to the backup member 18B, the conical portion 16B is compressed, and following this, as shown in FIG. 15, the connection electrodes 13A,13C which have taller heights, come into contact with the backup members 18A,18C, respectively, and compression in the backup members 18A, 18C is started. During this interval, the backup member 18B, which entered the compression process first, begins compression deformation first with the conical portion 16B while the pressing force of the connection electrode 13B is small because the conical portion 16B has a smaller spring constant than the cylindrical base portion 17. As the pressing force becomes larger, the compression deformation eventually moves to the cylindrical base portion 17B.

As shown in FIG. 10, when the conical portion 16 is compressionly deformed, the relationship between the spring force and the compression amount of the backup member 18, indicated by region A in FIG. 10, appears to be nonlinear. Further, when the cylindrical base portion 17 is compression deformed, the relationship between the spring force and the compression amount of the backup member 18, indicated by region B in FIG. 10, appears to be approximately linear. In other words, the spring force increases exponentially until a certain compression amount is reached, but when the compression amount exceeds this region or amount, the spring force increases linearly.

The relationship between the difference h in height of the connection electrodes 13 and the difference in pressing force on the connection electrodes 13 will now be described with reference to FIGS. 11 and 12. Graphs 10 and 12, in FIGS. 11 and 12, respectively, indicate the relationship between the spring force and the displacement of the backup member 18B, while graphs 11 and 13, in FIGS. 11 and 12, respectively, indicate the relationship between the spring force and the displacement of backup members 18A,18C.

First, when the displacement X1 of the backup member 18B, measured from where the backup member 18B contacts (L1) the connection electrode 13B having the shorter height to where the backup members 18A,18C contact (L2) the connection electrodes 13A,13C, respectively, having taller heights, is sufficiently smaller than the displacement of Y for the nonlinear elastic deformation region 10Y of the backup member 18B, the backup member 18B has obtained a displacement of X1+Z1 and the backup members 18A,18C have obtained a displacement of Z1, as shown in FIG. 11, at the time (L3) the head is mounted on the carriage. As can also be seen from FIG. 11, at the time (L3) when the head is mounted on the carriage, the spring forces of backup member 18B and of backup members 18A,18C are in the approximately linear deformation regions 10W and 11W, respectively. Consequently, the difference Q between the spring forces of backup member 18B and backup members 18A,18C is small, so the difference between the pressure on connection electrode 13B and the pressure on connection electrodes 13A,13C is also small.

However, when the difference h in height of the connection electrodes 13 is large and the displacement X2 of the backup member 18B, measured from where the backup member 18B contacts (L4) the connection electrode 13B having the shorter height to where the backup members 18A,18C contact (L5) the connection electrodes 13A,13C having taller heights, is larger than the displacement of Y for the nonlinear elastic deformation region 12Y of the backup member 18B, as shown in FIG. 12, the following problems arise. At the time (L6) when the head is mounted on the carriage, as shown in FIG. 12, the backup member 18B has obtained the displacement of X2+Z2 and the backup members 18A, 18C have obtained the displacement of Z2. As can also be seen from FIG. 12, at the time (L6) when the head is mounted on the carriage, the spring force B1 of backup member 18B is positioned in the approximately linear elastic deformation region 12W, while the spring force B2 of backup members 18A,18C is positioned in the nonlinear elastic deformation region 13Y. Consequently, the difference Q' between the spring force B1 of the connection electrode 13B having the shorter height and the spring forces B2 of the connection electrodes 13A,13C having taller heights becomes larger. That is to say, the pressing force on connection electrode 13B becomes very large with respect to the pressing force on connection electrodes 13A,13C. As a result, the pressing force on the connection electrodes 13A, 13C, having taller heights is insufficient, creating the problem that it becomes impossible to obtain good electrical connections.

SUMMARY OF THE INVENTION

In consideration of the foregoing, an object of the invention is to provide a connection electrode connecting device that can easily prevent poor contact with the connection electrodes.

In order to achieve this and other objectives, the invention is a connection electrode connecting device of the type comprising a plurality of opposing electrodes formed on a substrate surface; connection electrodes formed on approximately hemispherically shaped protrusions on a flexible substrate and positioned facing each of the opposing electrodes; and a support member which applies pressure from behind the protrusions, wherein the support member is comprised of a tip portion of pointed shape which contacts the back of the protrusion of the flexible substrate, the tip portion being formed of an inelastic material, and a cylindrical base portion which supports the tip portion and which is formed of an elastic material.

With the connection electrode connecting device of the invention having the described structure, the pointed tip portion, which is formed of an inelastic material, contacts the back of the protrusion of the flexible substrate while the cylindrical base portion, which is formed of an elastic material, supports the tip portion. Through this, the connection electrodes and the opposing electrodes are forced into contact with each other by the approximately linear spring force of the cylindrical base portion, and the connection electrodes and the opposing electrodes are thus electrically connected.

BRIEF DESCRIPTION OF THE DRAWINGS

A preferred embodiment of the invention will be described in detail with reference to the following figures wherein.

DETAILED DESCRIPTION OF PREFERRED EMBODIMENT

Figure 1:
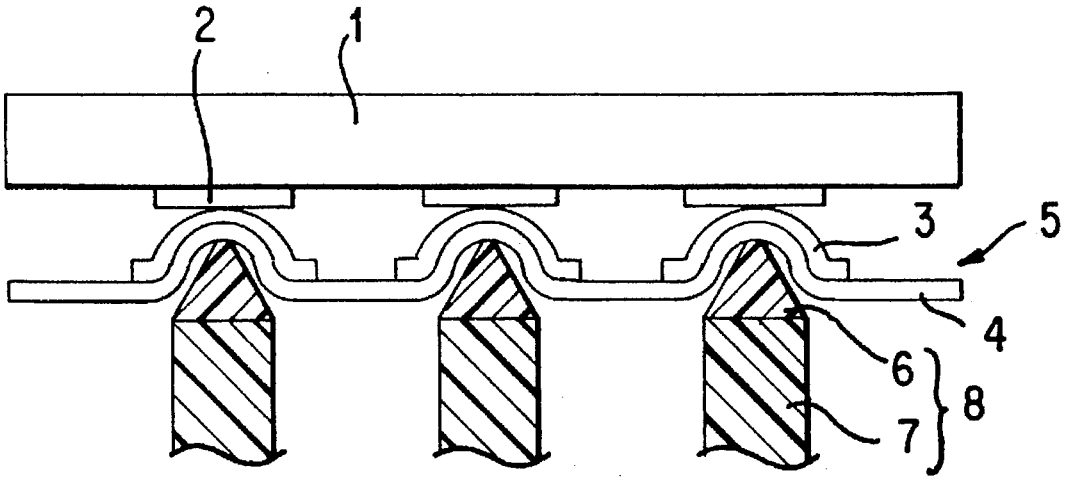
FIG. 1 is a cross-sectional diagram showing the composition of the connection electrode connecting device of the embodiment.
Figure 9:
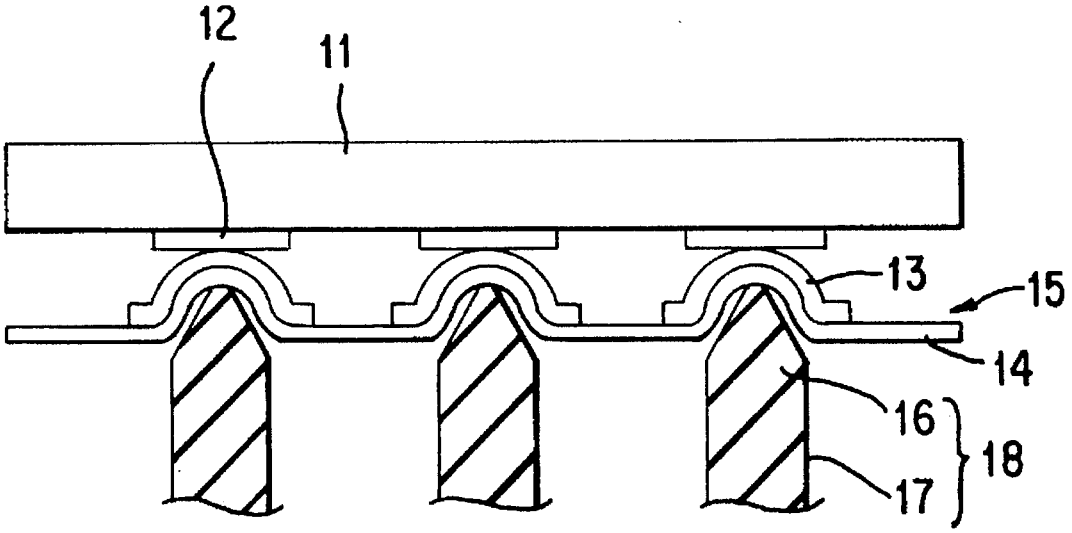
FIG. 9 is a cross-sectional diagram showing the composition of one type of conventional connection electrode connecting device.

A preferred embodiment of the invention is described hereafter, with reference to the drawings. FIG. 1 is a cross-sectional diagram showing the connection electrode connecting device of the embodiment. The connection electrode connecting device of the embodiment, such as that shown in FIG. 1, is positioned between the head and carriage of an ink ejecting print device (not shown). In this connection of the electrode connecting device, the connection electrodes 3 provided on the surface of a flexible substrate 5 provided on the carriage side are supported so as to be in pressure contact with opposing electrodes 2 provided on the surface of the opposing rigid substrate 1 which is provided on the head side.

The base film 4 of the flexible substrate 5 is formed of a pliable resin, such as polyimide or PET. Further, the positions where the electrodes 2 are provided are caused to protrude in an approximately hemispherical shape toward the rigid substrate 1 side by a press or similar process, and the connection electrodes 3 are provided on the protruding portions.

Backup members 8 are provided on the side of the base film 4 opposite the rigid substrate 1. The backup members 8 are each composed of a cylindrical base portion 7 and a conical tip portion 6 which contacts the concave surface of the base film 4 from the rear of each connection electrode 3. The conical tip portion 6 is formed of an inelastic resin, or similar material, which does not elastically deform even under pressure. For this inelastic resin, it is possible to use, for example, polycarbonate, polystyrene, or polyethylene terephthalate. The cylindrical base portion 7 is formed of an elastic resin or similar material having springiness, such as, for example, chloroprene rubber or silicone rubber. The conical tip portion 6 and the cylindrical base portion 7 may be attached by bonding or formed through insertion molding or similar manufacturing techniques.

The backup members 8, each composed of a conical tip portion 6 and a cylindrical base portion 7, are supported by a support plate (not shown) at positions corresponding to the plurality of connection electrodes 3. The support plate may support the bottom of the cylindrical base portion 7 or may provide support by penetrating into the cylindrical base portion 7.

In addition, the radius of curvature of the conical tip portions 6 is configured so as to be smaller than the radius of curvature of the protrusions on the base film 4 to which each corresponds.

Figure 5:
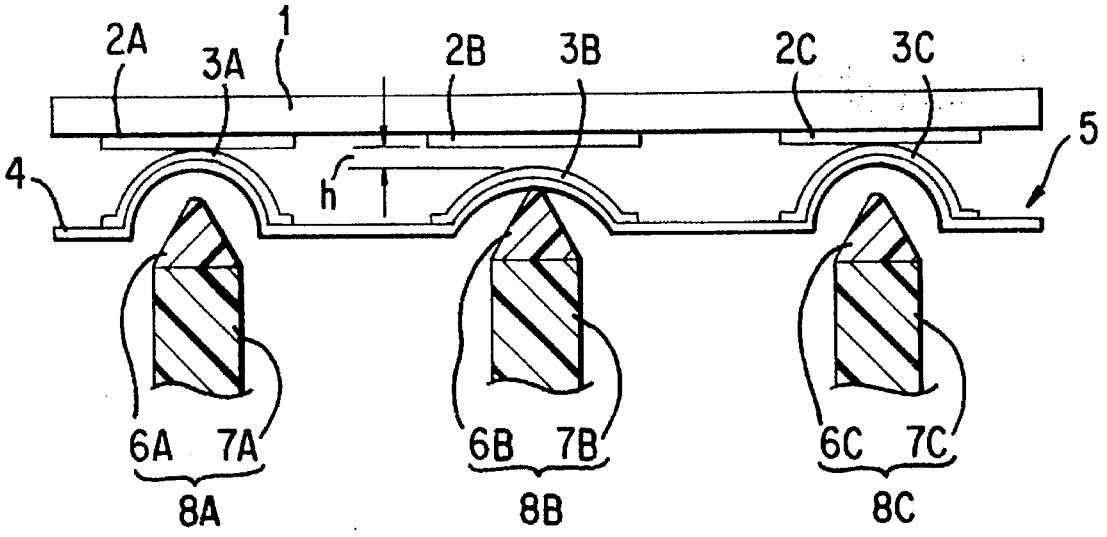
FIG. 5 is a cross-sectional diagram showing the composition of the connection electrode connecting device of the embodiment.

Next, as shown in FIG. 5, the process of each of the connection electrodes 3A,3B,3C being pressed against each of the opposing electrodes 2A,2B,2C is described for the case when an interposed connection electrode 3B has a height that is shorter by the amount h than the connection electrodes 3A,3C on either side.

First, the connection electrodes 3A,3C on the two sides, which are taller by an amount h, come into contact with their opposing electrodes 2A,2C, respectively, of the opposing rigid substrate 1. Next, the conical tip portion 6B, of backup member 8B, comes into contact with the back of connection electrode 3B. Up to this time, the backup members 8A,8C, on either side of backup member 8B, are not in contact with the back of the respective corresponding connection electrodes 3A,3C so no pressure is applied between the backup members 8A,8C and the rigid substrate 1.

Figure 2:
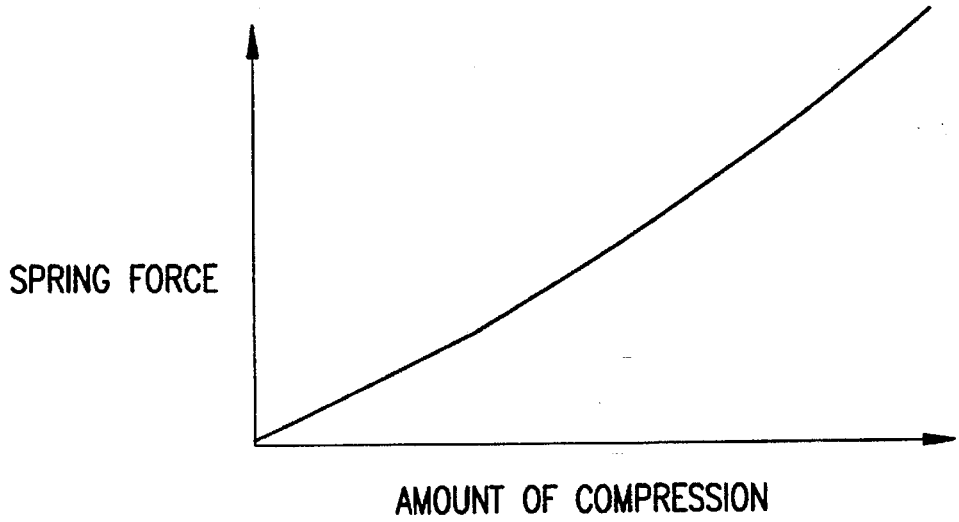
FIG. 2 is a diagram showing the properties of the backup member of the connection electrode connecting device of the embodiment.
Figure 6:
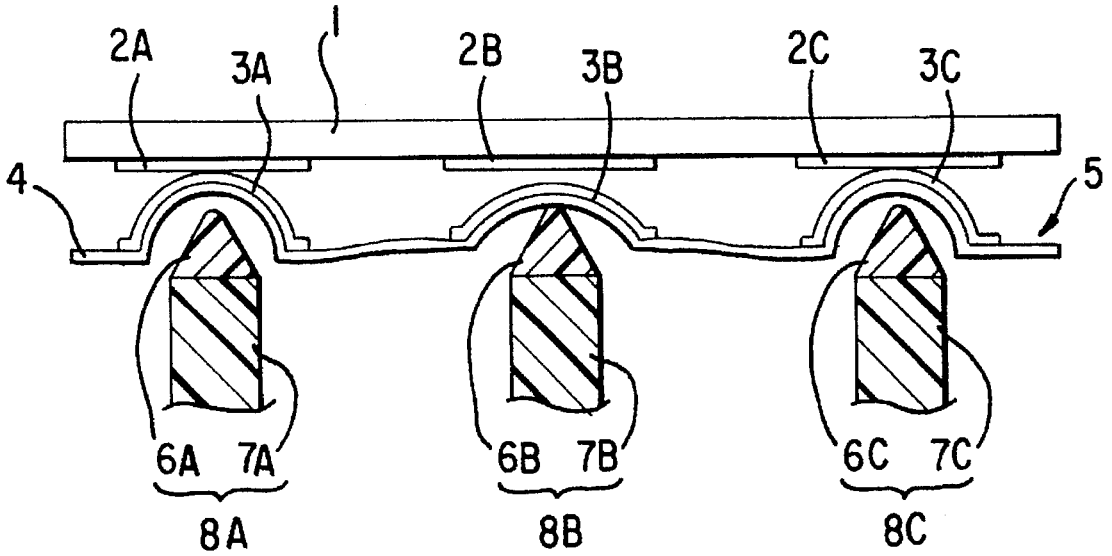
FIG. 6 is a cross-sectional diagram showing the connection process of the connection electrode connecting device of the embodiment.

When the pressing force is increased from this stage, the flexible substrate 5 is first deformed and a force that presses the protrusion above backup member 8B in the direction of the rigid substrate 1 is created in the backup member 8B, as shown in FIG. 6. At this time, the conical tip portion 6B of the backup member 8B does not elastically deform even under this force because the tip portion 6B is composed of an inelastic material. 0n the other hand, the cylindrical base portion 7B of the backup member 8B is composed of an elastic material so only this portion is compression deformed by the applied force. Consequently, the backup member 8B creates an approximately linear spring force corresponding to the amount of compression, as shown in FIG. 2.

Figure 7:
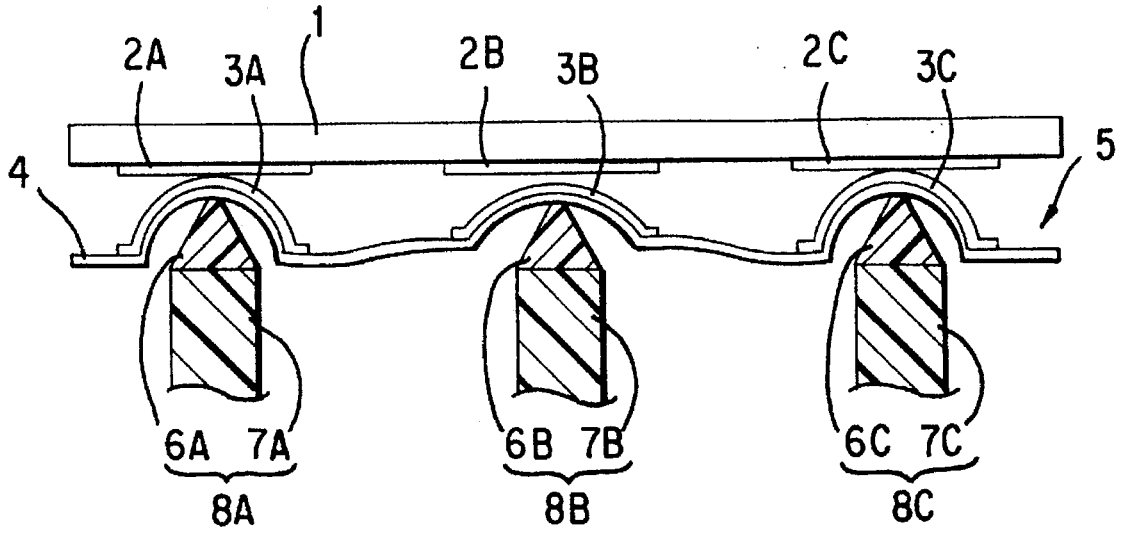
FIG. 7 is a cross-sectional diagram showing the connection process of the connection electrode connecting device of the embodiment.
Figure 8:
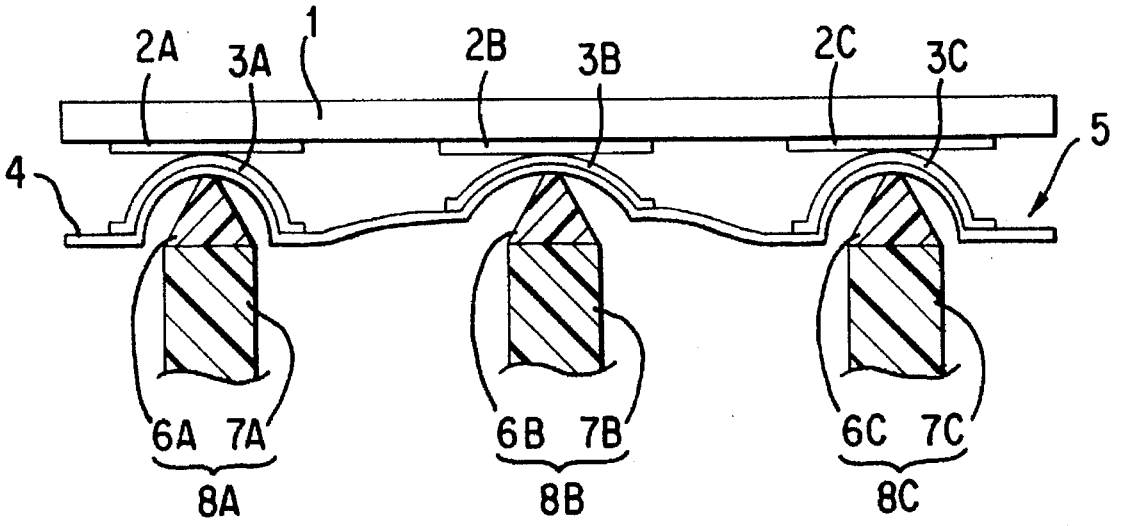
FIG. 8 is a cross-sectional diagram showing the connected state of the connection electrode connecting device of the embodiment.
Figure 10:
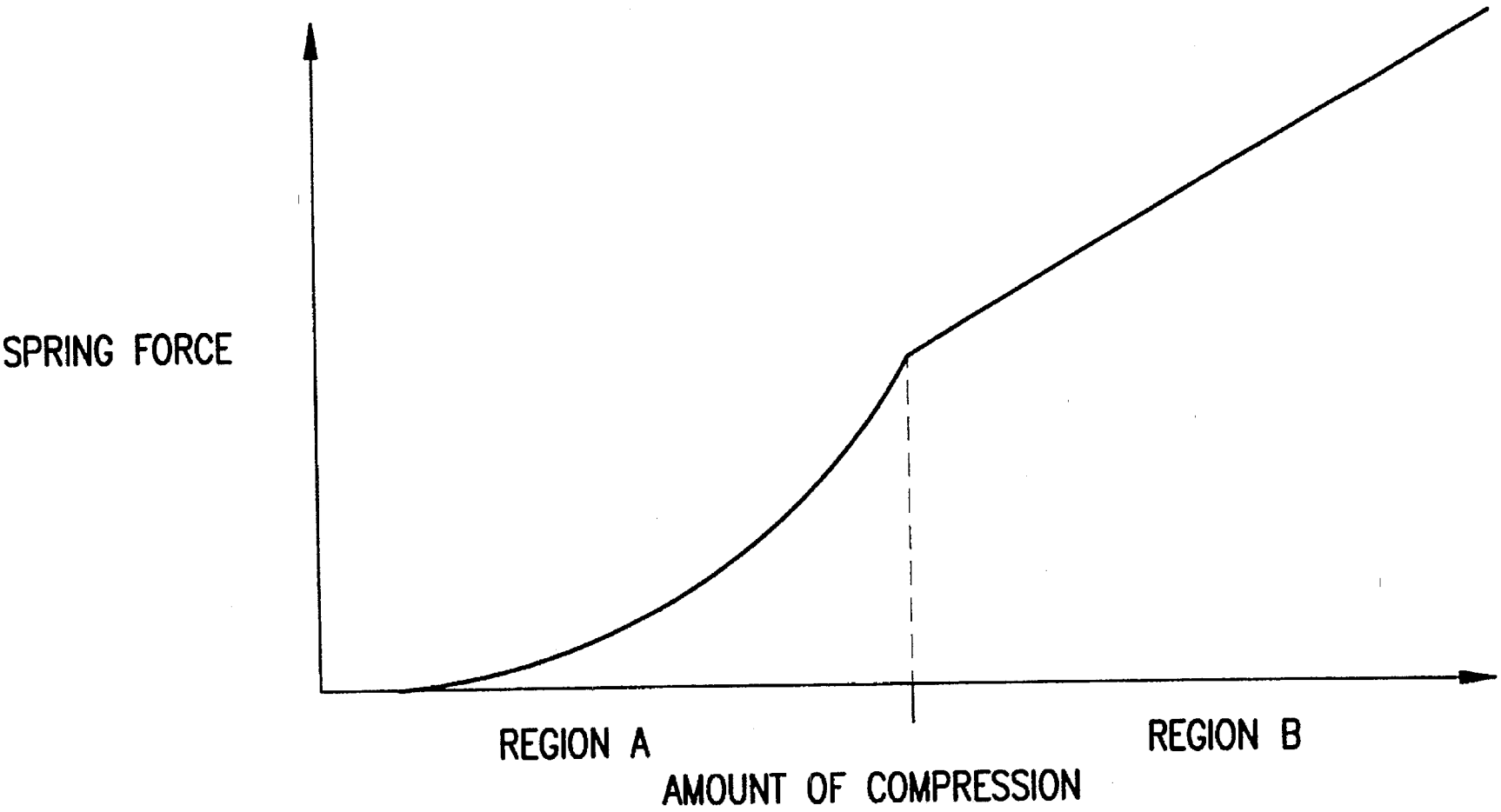
FIG. 10 RELATED ART
FIG. 10 is a diagram showing the properties of the backup member of one type of conventional connection electrode connecting device.
Figure 11:
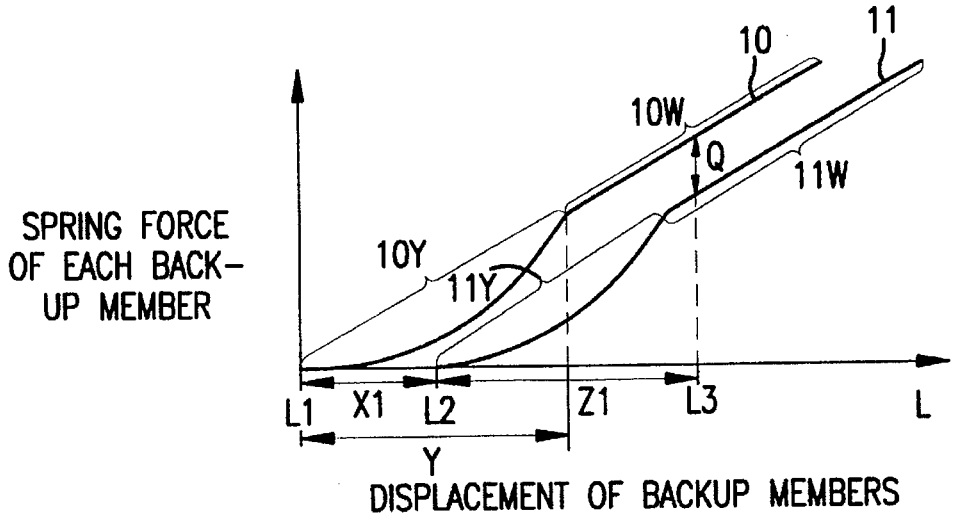
FIG.11 RELATED ART
FIG. 11 is a diagram showing the properties of one type of conventional connection electrode connecting device.
Figure 12:
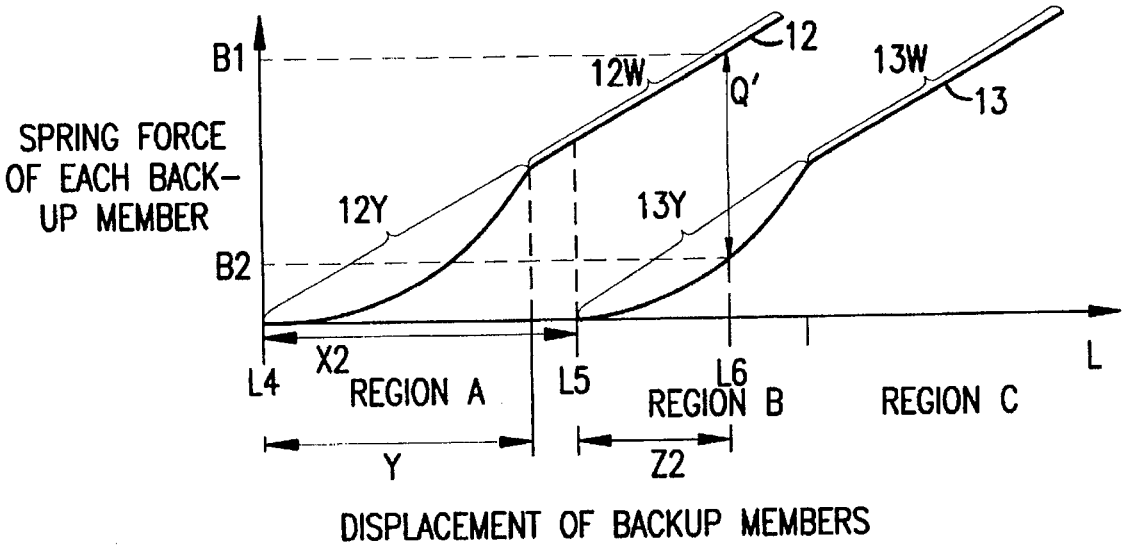
FIG.12 RELATED ART
FIG. 12 is a diagram showing the properties of one type of conventional connection electrode connecting device.
Figure 13:
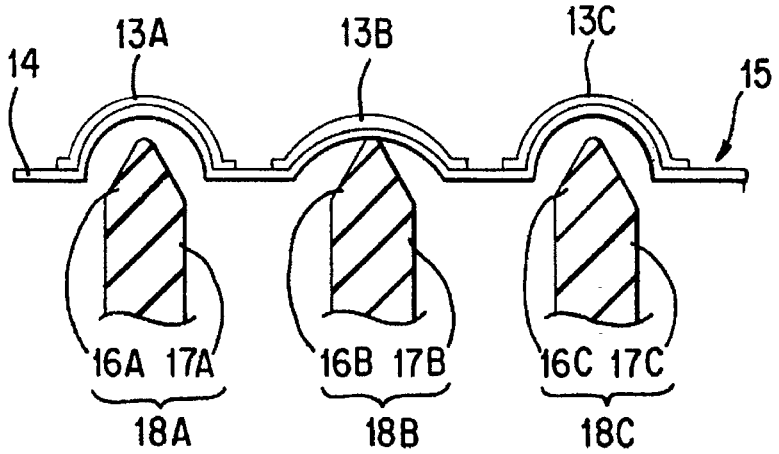
FIG.13 RELATED ART
FIG. 13 is a cross-sectional drawing showing the composition of one type of conventional connection electrode connecting device.
Figure 14:
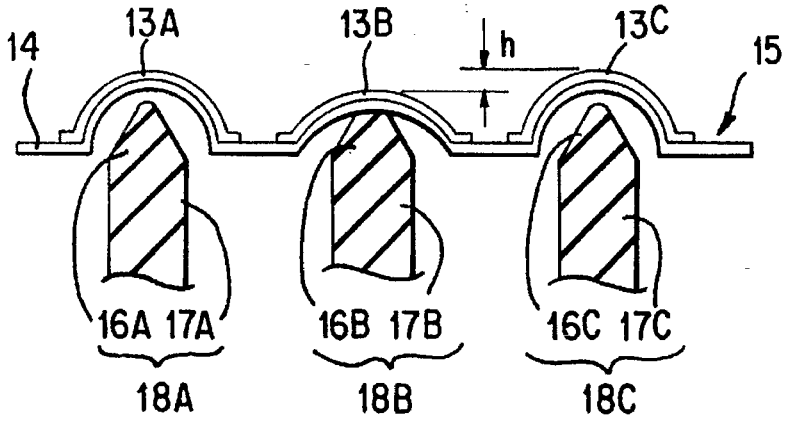
FIG.14 RELATED ART
FIG. 14 is a cross-sectional diagram showing the connection process of one type of conventional connection electrode connecting device.
Figure 15:
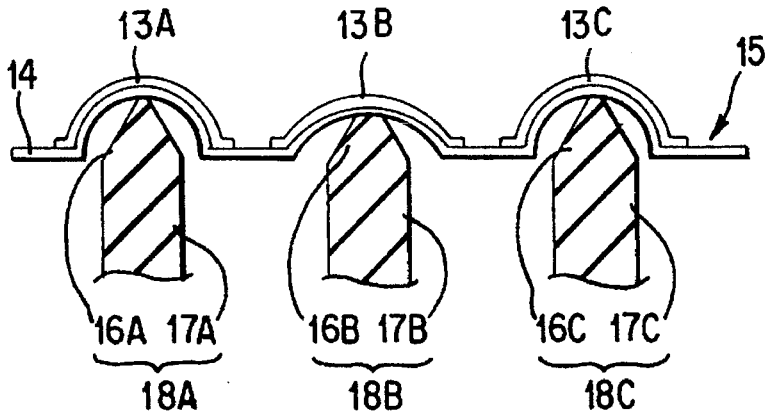
FIG.15 RELATED ART
FIG. 15 is a cross-sectional diagram showing the connected state of one type of conventional connection electrode connecting device.

Furthermore, as the pressing force increases further, the conical tip portions 6A,6C of backup members 8A,8C come into contact with the connection electrodes 3A,3C, as shown in FIG. 7. As the pressing force increases still further, the flexible substrate 5 is deformed by the difference h between the heights of the protrusions because of the pressure exerted by the backup member 8B, so that contact between the connection electrode 3B and the opposing electrode 2B is possible. Thus, contact is made between the connection electrodes 3A,3B,3C and the respective opposing electrodes 2A,2B,2C.

However, the contact pressure between the connection electrodes 3A,3C on either side, and the respective opposing electrodes 2A,2C at this time is about half of the force needed to deform the flexible substrate 5 by a height h, but the spring force of the backup members 8A,8B does not act. Accordingly, with the pressing force at this time, the pressing force is still not great enough that a good electrical connection is made with each of the connection electrodes 3A,3B,3C.

When a further pressing force is applied to each of the backup members 8A,8B,8C, the connection electrode 3B, which has already obtained a certain degree of contact force, further increases the contact force. On the other hand, the spring force from backup members 8A,8C is applied for the first time to the connection electrodes 3A,3C on either side of backup member 8B at this stage.

Figure 3:
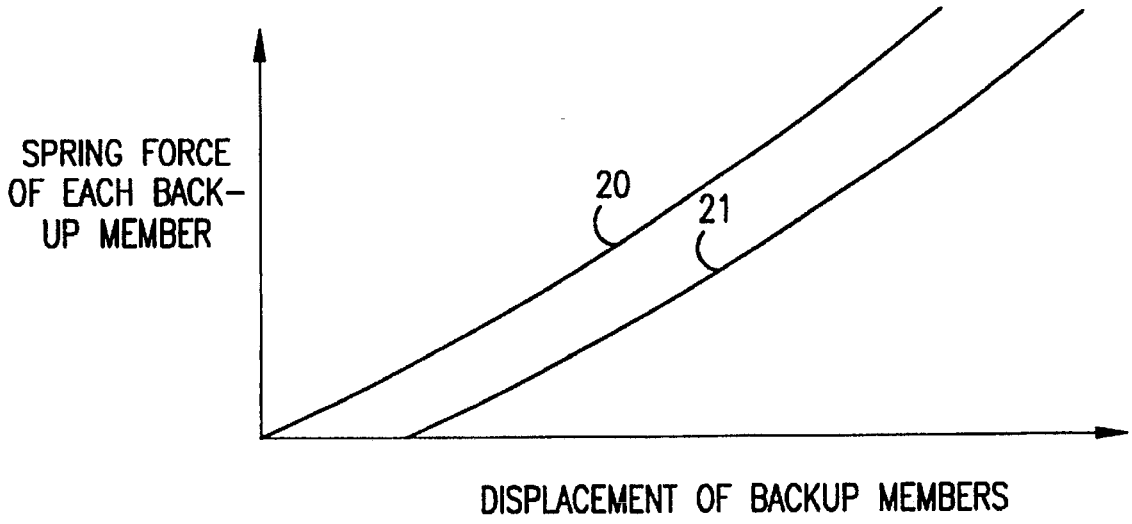
FIG. 3 is a diagram showing the properties of the connection electrode connecting device of the embodiment.
Figure 4:
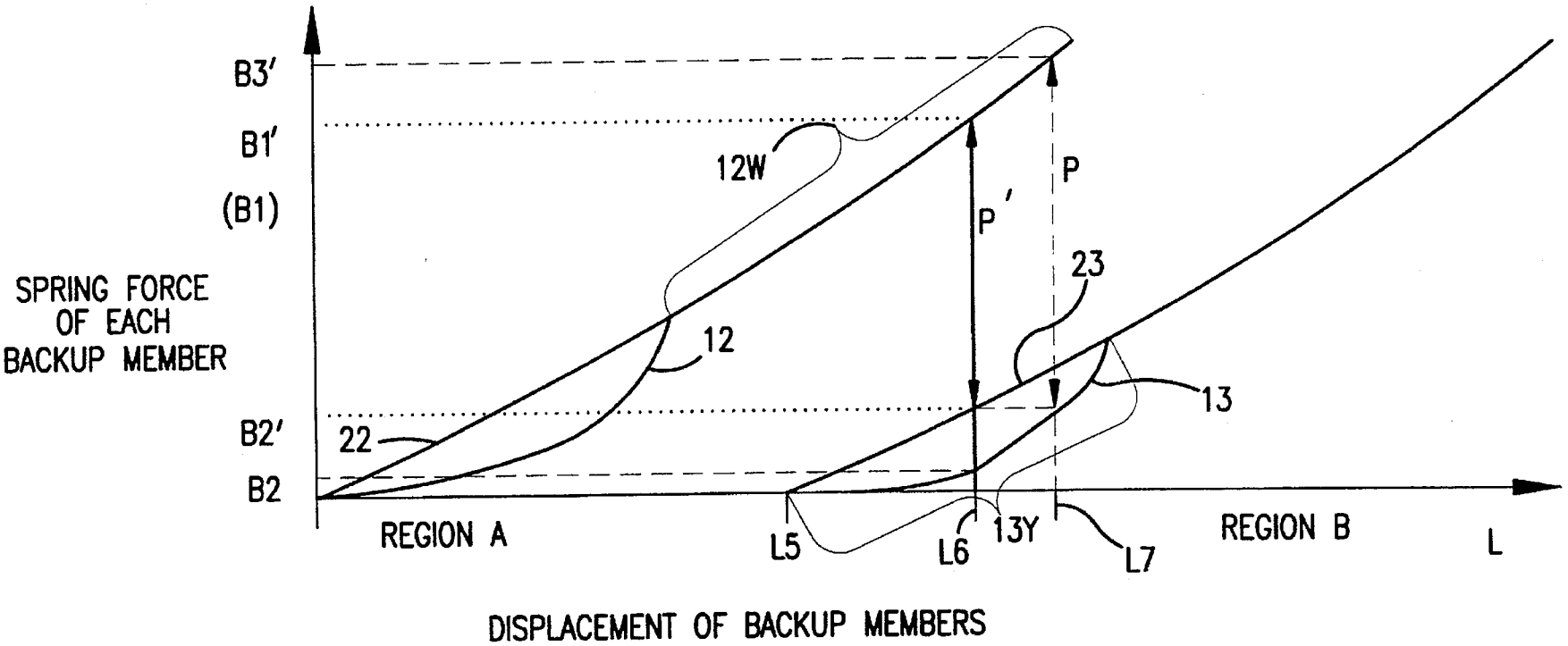
FIG. 4 is a diagram showing the properties of the connection electrode connecting device of the embodiment.

FIGS. 3 and 4 show the relationship between the amount of compression of backup members 8A,8B,8C and the spring force created thereby when there is a difference in height among the connection electrodes 3A,3B,3C. In FIGS. 3 and 4, graphs 20 and 22 indicate the relationship between the displacement and the spring force created in the backup member 8B of the connection electrode 3B having the shorter height, while graphs 21 and 23 indicate the relationship between the displacement and the spring force created in backup members 8A,8C of connection electrodes 3A,3C having the taller heights. As is clear from FIGS. 3 and 4, the spring force created in each of the backup members 8A,8B, 8C is approximately linear with respect to the displacement and, consequently, even if the displacement increases, the relative difference substantially does not change because none of the spring forces change dramatically.

As a result, when the difference h in heights between connection electrode 3B and connection electrodes 3A,3C is large, the contact pressure (B1') obtained by the connection electrode 3B of shorter height is larger than the contact pressure obtained by the connection electrodes 3A,3C when the minimum contact pressure (B2') of the connection electrodes of taller height needed to obtain a good electrical connection is obtained, as shown in FIG. 4. Calling B1' the contact pressure of connection electrode 3B at this time, that is to say the spring force created by backup member 8B, the contact pressure of connection electrodes 3A,3C, that is to say the spring force created by backup members 8A,8C, becomes B2'.

If the heights of all of the connection electrodes 3A,3B,3C are the same, the pressing force, that is to say spring force, needed for the connection electrodes 3 to obtain good electrical connections, is B2', so the entire pressing force that is applied to the three connection electrodes 3 is of necessity a minimum of:

$3 \times B2'$

However, when there is a difference of h between the heights of connection electrode 3B and connection electrodes 3A,3C, as shown in FIG. 5, the overall pressing force that must be applied to the three connection electrodes in order for the connection electrodes 3 to obtain good electrical connections is:

$3 \times B2' + P'$

In other words, the pressing force that works between the rigid substrate 1 and the backup members 8 is the sum of the pressing force needed in order for each of the connection electrodes 3 to obtain a good electrical connection multiplied by the number of connection electrodes ($3 \times B2'$), and the pressing force P' (B1'−B2') needed for the flexible substrate 5 to be deformed by the difference h in height between the connection electrodes 3.

For convenience, the displacement of the backup member 8 in FIG. 4 is divided into two regions, region A and region B, and if the minimum pressing force needed for the connection electrodes 3 to obtain good electrical connections is referred to B2' as described above, the pressing force necessary for all of the electrodes to obtain good electrical connections cannot be obtained if a displacement of region B or higher is not applied to backup member 8B. Consequently, the greater the difference h in height between the protrusions, the farther the point L5, where the conical tip portion 6B of the backup member 8B contacts the back of the connection electrode 3B, moves in the positive direction of region B, and the farther the displacement of the backup members 8 also moves in the positive direction of region B.

In this instance, with reference to FIG. 4, a comparison will be made between graphs 12 and 13, which indicate the relationship between the displacement and the spring force of the backup members 18 in one type of conventional connection electrode connective device, and graphs 22 and 23, which indicate the relationship between the displacement and spring force of backup members 8 in the connection electrode connecting device of the present embodiment. Because graph 13 has a non-linear region, when graph 13 obtains the minimum spring force B2' necessary for good electrical connections for the connection electrodes 3, the displacement L7 of the backup members 18A,18C of graph 13 moves in the positive direction more than the displacement L6 of the backup members 8A,8C of graph 23. In addition, when the displacement of the backup members 18B is at L7, graph 12 obtains the spring force B3'. This spring force B3' is larger than spring force B1'. As a result, when there is a difference in height among the connection electrodes 3, the sum of all of the pressing forces needed in order to obtain good electrical connections for the connection electrodes 3 becomes larger in the case of the conventional connection electrode connecting device than in the present embodiment. In other words, in the connection electrode device of the invention, the sum of all of the pressing forces needed in order to obtain good electrical connections for the connection electrodes 3 is small.

In addition, the difference of the spring forces

P' (B1'–B2')

in the embodiment, as shown in FIG. 4, is the difference between the spring forces B1' and B2' of linear graphs 22 and 23, and consequently, it is clear that this is smaller than the difference between spring forces in the conventional model, which is to say the difference

P(B3'–B2')

between the spring force of the approximately linear elastic deformation region 12W and the spring force B2' of the non-linear elastic deformation region 13Y. In other words, in order for all of the connection electrodes 3 on the plurality of protrusions to obtain the minimum pressing force B2' necessary for good electrical connections, the total sum of the pressing forces applied to all of the connection electrodes 3, expressed by 3×B2'+P', is smaller in the case of the invention than in the case of the conventional model.

In addition, with the embodiment, because graphs 22 and 23 are approximately linear, at the time (L6 in FIG. 4) when the head is mounted on the carriage, the spring force B2' of the backup members 8A,8C (graph 23) of the present embodiment is higher than the spring force B2 of the conventional backup members 18A,18B (graph 13). That is, the spring force applied to the connection electrodes 3A,3C when the head is mounted on the carriage, is higher with the invention than with the conventional model so that poor connections of the connection electrodes do not arise as easily.

In this way, with the connection electrode connecting device of the embodiment, the conical tip portions 6 formed of an inelastic material contact the back of the protrusions of the flexible substrate 5, and cylindrical base portions 7 formed of an elastic material support the conical tip portions 6. Consequently, the connection electrodes 3 and opposing electrodes 2 are pressed into contact with each other and a linear spring force is created as the cylindrical base portions 7 are compressed. Consequently, even when there is a difference in height among the plurality of connection electrodes 3 positioned on the flexible substrate 5, the difference in contact pressure applied to each of the connection electrodes 3 is smaller than that of a conventional model because the cylindrical base portions 7 create a linear spring force with respect to the amount of compression of the base portions. Thus, it is possible to make electrical connections between the connection electrodes 3 and the opposing electrodes 2 with certainty and with few poor contacts.

In addition, because the sum of the pressing forces needed for good electrical connections is smaller than in the conventional model, it is possible to make this connection electrode connecting device with a mechanism that has a reduced rigidity, making it possible to-make the device lighter in weight.

With the embodiment, a description is provided for a case wherein the connection electrode 3B is lower in height than the electrodes 3A,3C on either side, but the same operation as above can be used even when one of the outside connection electrodes 3A or 3C is lower in height than the inner electrode 3B.

In addition, with the embodiment, the tip portion 6 is conical in shape but it would be fine for it to be the shape of a polygonal spindle. Furthermore, the base portion is cylindrical in shape, but it would be fine for to have the shape of a polygonal column.

The embodiment is intended to be illustrative and not limiting. It is evident that many alternatives, modifications and variations will be apparent to those skilled in the art, and such are also included within the scope of the invention.

What is claimed is:

1. A connection electrode connecting device, comprising:

a plurality of opposing electrodes provided on a substrate surface;

connection electrodes which are formed on protrusions of approximately hemispherical shape on a flexible substrate positioned so as to face each of the opposing electrodes;

conical tip portions of an inelastic material which contact the rear of the protrusions on the flexible substrate and apply a pressing force to a rear of the protrusions; and cylindrical base portions formed of an elastic material which support the tip portions.

2. The connection electrode connecting device of claim 1, wherein the cylindrical base portions of the support members have the shape of pillars.

3. The connection electrode connecting device of claim 1, wherein the inelastic material of said conical tip portions is selected from a group of materials consisting of polycarbonate, polystyrene and polyethylene terephthalate.

4. The connection electrode connecting device of claim 3, wherein the elastic material of said cylindrical base portions is selected from a group of materials consisting of resilient resins, chloroprene rubber and silicone rubber.

5. The connection electrode connecting device of claim 1, wherein a compression coefficient of said cylindrical base portions is substantially linear, each cylindrical base portion commencing compression when initial pressure is applied to a corresponding conical tip portion.

6. A connection electrode connecting device, comprising:

a flexible substrate having at least one protrusion from a first surface;

a connection electrode mounted over and conforming to each said protrusion; and a backup member opposing a second surface of said flexible substrate and associated with each said protrusion, wherein said backup member has a tip portion formed of a non-elastic material and a base portion formed of an elastic material.

7. The connection electrode of claim 6, wherein said tip portion and said base portion have different geometric shapes.

8. The connection electrode of claim 7, wherein said tip portion has a conical shape and said base portion has a cylindrical shape.

9. The connection electrode of claim 7, wherein said non-elastic material is a non-elastic resin.

10. The connection electrode of claim 6, wherein each said protrusion has a hemispherical shape.

11. The connection electrode of claim 10, wherein a tip of said tip portion has a smaller radius of curvature than a radius of curvature of said protrusion.

12. The connection electrode of claim 9, wherein said tip portion is selected from a group of resins consisting of polycarbonate, polystyrene and polyethylene terephthalate.

13. The connection electrode of claim 7, wherein said base portion is formed of a resilient resin.

14. The connection electrode of claim 13, wherein, in addition to being formed from a resilient resin, said base portion is formed by a material selected from a group further consisting of chloroprene rubber and silicone rubber.

15. The connection electrode of claim 6, wherein a compression coefficient of said base portion is substantially linear, said base portion commencing compression when initial pressure is applied to said tip portion.

* * * * *